US008033873B2

(12) United States Patent
Ankerstjerne

(10) Patent No.: US 8,033,873 B2
(45) Date of Patent: Oct. 11, 2011

(54) PATCH CABLE PHYSICAL LINK IDENTIFICATION DEVICE

(75) Inventor: William D. Ankerstjerne, Coatesville, PA (US)

(73) Assignee: Link Light Technologies, Inc., Coatesville, PA (US)

( * ) Notice: Subject to any disclaimer, the term of this patent is extended or adjusted under 35 U.S.C. 154(b) by 1592 days.

(21) Appl. No.: 11/198,480

(22) Filed: Aug. 5, 2005

(65) Prior Publication Data

US 2006/0046580 A1 Mar. 2, 2006

Related U.S. Application Data

(60) Provisional application No. 60/522,195, filed on Aug. 30, 2004.

(51) Int. Cl.
*H01R 9/22* (2006.01)

(52) U.S. Cl. ..... 439/713; 379/22.03; 379/22.07; 379/413.03; 379/433.05; 379/438; 439/36; 439/39; 439/42; 439/56; 439/75; 439/119; 439/226; 439/714; 439/715; 439/716

(58) Field of Classification Search ..... 379/22.03, 379/22.07, 26.02, 413.03, 433.05, 438; 324/66, 324/149; 439/36, 39, 42, 56, 75, 119, 226, 439/714, 715, 716

See application file for complete search history.

(56) References Cited

U.S. PATENT DOCUMENTS

| | | | | |
|---|---|---|---|---|
| 4,703,497 | A | 10/1987 | Ingalsbe | |
| 4,837,488 | A | 6/1989 | Donahue | |
| 5,179,253 | A | 1/1993 | Munniksma et al. | |
| 5,764,043 | A * | 6/1998 | Czosnowski et al. | 324/66 |
| 5,847,557 | A | 12/1998 | Fincher et al. | |
| 6,577,243 | B1 * | 6/2003 | Dannenmann et al. | 340/815.45 |
| 6,750,643 | B2 | 6/2004 | Hwang et al. | |
| 6,975,242 | B2 * | 12/2005 | Dannenmann et al. | 340/815.45 |

* cited by examiner

*Primary Examiner* — Curtis Kuntz
*Assistant Examiner* — Yosef K Laekemariam
(74) *Attorney, Agent, or Firm* — Robert B. Famiglio, Esquire; Famiglio & Associates

(57) ABSTRACT

A system for locating corresponding ends of a communications or data patch cable used to conduct a signal between computing or telecommunications devices. The invention provides a physical indication of the location of an opposite end of a given patch cable when a switching means on the first end of the same cable is activated. The invention utilizes an existing pair of wires in category-type cables to send a DC voltage when activated to illuminate a light emitting diode in the opposite end of a patch cable thereby providing an immediate indication of the location of the termination of the opposite end of a patch cable making it possible to visually identify a cable without removing the cable from service or from connection of the modular plugs on either end of the cable.

10 Claims, 3 Drawing Sheets

PATCH CABLE PHYSICAL LINK IDENTIFICATION DEVICE

CROSS REFERENCES TO RELATED APPLICATIONS

This application claims the benefit of the applicant's provisional application Ser. No. 60/522,195 which was filed Aug. 30, 2004 and assigned to the assignee of the present application.

BACKGROUND OF THE INVENTION

1. Field of the Invention

The present invention relates to communications and data processing patch cords and cables used in telephone systems, computer networking systems including ethernet connections, and for other electronic cabling systems.

2. Description of the Related Art

Communications and computer networking systems generally utilize cabling complying with certain standards such as ethernet or other related cabling standard protocols. Many buildings utilize networking cable which conforms to an ethernet standard utilizing what is commonly known as Category 5 ("Cat 5") Wire standards or higher. Telephone systems such as electronic telephone switches and private branch exchanges may utilize similar cabling known as Category 3 ("Cat 3") Wire. In all of the categories commonly available for communications cabling or networking patch cords, modular type plugs are used at each end of one particular branch in order to connect the cabling from a device such as a telephone or a computer network card, to an area where patch panels are supplied to allow flexibility in the cabling topography in any one location. Such cable installations are commonly referred to "premise wiring" being the cabling that is permanently installed throughout the building as part of the building utility or information infrastructure and ultimately is consolidated to a MDF (main data frame/facility) or several IDF's (intermediate data frames/facilities connecting to the MDF in larger facilities) where the consolidated patch panels are located as well as centrally located data devices needing to be connected to the premise wiring. Premise wiring is fixed in nature, that is, once installed, such wiring is dedicated to identified or defined locations within the premises.

Networking closets where connecting cabling generally converges can be difficult to manage in middle to large scale installations where there may be dozens, and perhaps hundreds of cable converging in a closet where patch panels are utilized to allow flexibility in connections and reconfiguration of the networking layout. In most telephone communications and networking wiring closets (referred to MDF or IDF), there are multiple devices which include switches, routers, hubs, servers, telecommunications equipment and other devices which all are connected using conventional patch panels. Patch panels, usually a starting point of the premises wiring, allow flexibility in the interconnection of the physical wires that are run through the facility being served. The wires used in such installations are intended to deliver data and voice to the various locations throughout a physical environment, such as an office building, multiple building campus or the like.

Patch panels and data devices must be connected together via a cable length commonly referred to as a "patch cable". Commonly, the cables running through the physical plant or building converging on a given network closet number in the hundreds and are typically of like design, length and color, without any distinctive identifying marks. Even if various colors are used to designate the difference between telephone cabling, computer network cabling or video cabling, it is still difficult to differentiate between the groups of cable within one category.

In a modest office building, for example, with thirty-five different offices within the building, there can be at least thirty-five different network cables converging on a network cable closet, as well as thirty-five or more telephone cables and other communications or data cables which may include video cabling also. In such installations all of the premises wiring is run to a termination point, being the patch panel or several patch panels at either an MDF or an IDF. From the patch panel, patch cables are run to the appropriate devices commonly located in the networking closet which may be standard rack configured equipment or devices such as the hubs, routers, computers, remote disk drives or even the servers themselves. In the simplest terms, a patch cable, as referenced in this application, can be thought of as an extension cord to plugging in the phone or the computer from the termination point on the patch panel to the ultimate device being connected to each individual computer or telephone.

In such a cabling environment the cables are normally bundled together and run through a series of cable management devices which can be wire ties, hooks, cable trays and other conduits to get the cables from the device in a particular office to the patch panel in the networking closet. Connections are not permanent and they often need to be moved between various devices on demand or to reconfigure the data processing network or telephone system being used. The very reason patch panels exist are to allow reconfiguration of the cables without the need to permanently rewire the end of the cable terminating in the wire or cable closet. One particular connection from the networking closet must go to a specific location in the building to correlate to the intended use for a telephone or a particular network device such as a laptop or desktop computer.

Currently a popular way to keep track of the corresponding ends of a particular physical cable is to run one cable at a time and create a physical written log that references where each cable starts and finishes. Such a log would reference connection points, not the cables themselves. For example, a log may say that patch panel port #1 goes to switch #3, port #5, and is used for data. This is repeated hundreds of times and this conventional effort at keeping track of the topography or configuration of the physical wiring in a given building becomes a problem. Not only is it time consuming, it's sometimes inaccurate, and it is not always a permanent reference.

Also, under normal circumstances, if the log gets lost, or the writer makes a mistake, or if any changes are made in the wiring closet that are not documented (a common situation), one must start the entire process over. Such a process also does not account for the addition of new devices to the network closet or to the device or equipment rack contained therein, additional premise wiring being installed and needing to be patched into the system, individual patch cabling replacement due to upgrade or failure (which would need to be completed one cable at a time to maintain or create a log), or a network device being removed.

It is also possible to place hang tags on the end of cables, or to put bands on the cable which have a number corresponding to the same cable at each end. For example, a given cable can be marked "D-30" on each end of the cable so that one would be able to search through a bundle looking for the same reference at the other end of the cable. This is time consuming in itself, and labels fall off, are difficult to find within a thick bundle of cables, and otherwise are occasionally misread if they are reviewed upside-down and must be addressed on a one by one basis.

A common example of errors in log keeping might be that if a network cabling technician is requested to take ports 100 through 105 on a given patch panel which may be currently assigned to a telephone device, and switch them over to a data device, then the wiring log does not accurately reflect where the cables on ports 100 to 105 are plugged in. Such an event is common in buildings where there may be limited numbers of ports available into a given room. A conference room may need to temporarily reassign jacks from telephone use to data use for multiple computers in presentations or other temporary needs. On the other end of each cable, one has to physically verify the routing of each individual cable. This may entail unplugging each cable one at a time and following it through the hundreds of cables in the wire management devices to determine where it terminates on the other end, and what equipment it may be plugged into. This is and has been a time consuming task for many wiring technicians and network administrators.

The most commonly found wiring scheme in most physical cabling layouts today are the Category 3, 5 and 6 cabling for which the standards are well known in a variety of uses for telecommunications and ethernet networking. The ubiquitous ethernet plug termination device is known as an RJ45 modular connector which is used for Category 3, Category 5 and Category 6 wiring. The typical unshielded twisted pair (UTP) or shielded twisted pair (STP) category cables have eight wires or conductors, which comprise four pairs of wires. Each pair can consist of a solid color wire and a white and color striped wire of the same color to designate the pair. Each of the pairs are twisted together to utilize noise cancellation and to prevent radiation of a signal as is a required characteristic of ethernet cabling.

The pairs designated for conventional 10BaseT ethernet or 100BaseT ethernet are orange and green in a typical Category 5 cable. The other two pairs in the cable, brown and blue, are unused for virtually all applications. The two wiring standards for these cables are called T-568A and T-568B. These standards differ only in pin assignments, not in the uses of the various colors in the standard code. The T-568A specification reverses the orange and green connections, so that the blue and orange pairs are on the center four pins of a typical connector, which makes in more compatible with telephone voice connections. Although it should be noted that most off-the-shelf data equipment and cables seem to be wired for the T-568B standard, there is no difference in connectivity between the T-568B and the T-568A cables. Either wiring may be found in typical systems.

The eight conductor (four pairs) of wiring for a typical ethernet plug is terminated in the RJ45 ("Registered Jack45") modular connector. There are eight connection pins in the RJ45 numbered accordingly. As mentioned above, there are four conductors (two pairs) that typically are not used at all in most applications. Virtually all of the patch cables used in category wiring are of the RJ45 type, although the smaller RJ-11 ("Registered Jack-11") type connector is used for many telephone cabling and has four or six wire connections.

It would be useful to have a system in which it would be immediately apparent as to where the opposite end of a given patch cable currently connected to a patch panel may terminate. Although there are portable devices which can be plugged into cable jacks to send tones, and other signals which may be received on the opposite end of a connector or panel by plugging in a corresponding test device, there is a need for an integrated system which is built in to a given patch cable and does not require external connections, test equipment or other complicated testing protocol. Many of the test devices now used in confirming network cable and patch panel performance still require that the user find the other end of a patch cable to test the connection anyway.

It is, accordingly, the object of the present invention to present a means to identify and locate the opposite end of a data or telecommunications patch cord without removing the cord from service and without applying any external apparatus.

It is also an object of the present invention to present a means to integrate a cable end identification system within a given ethernet or telecommunications patch cord.

It is yet a further object of the present invention to provide a computer patch cord cable system which contains an internal power supply integrated into a modular plug on the cable, with a modular plug on the opposite end of the cable containing an integrated light signaling means operatively connected through the patch cable to the power supply which may be selectively activated to provide recognition of the matching ends of the said patch cable.

It is also an object of the present invention to provide a modular plug in the form of a RJ45 style connector for use in ethernet and other networking environments which contain an integrated cable end identification system within the connector to allow for direct retrofit or new cable construction which may be used in an existing ethernet environment without any need to change the configuration of the system wiring.

SUMMARY OF THE INVENTION

The present invention is directed to an internal, self-contained system of identifying the matching ends of a given category style cable patch cord. In the simplest preferred embodiment, the system utilizes an internal battery source on one end of an otherwise generally conventional modular plug or connector and a light emitting diode integrated into the modular connector located at the opposite end of a given patch cord. By manipulating a momentary contact spring loaded switch on a first connector on the patch cord, the modular connector on the opposite side of a given patch cord illuminates, thereby providing a visual signal of the precise termination of a given patch cord without removing the cord or applying any external testing means.

The device utilizes a single unused pair of wires connected to a typical RJ-45 ethernet plug to carry DC voltage from a small long life battery integrated into a first modular plug, sending such voltage when activated through a switch to a light emitting diode molded within the modular plug located at the opposite end of the same patch cord. When a switch is pushed on the first connector, voltage is passed through one pair of the category wiring facilitating an isolated positive and negative DC connection to the light emitting diode end of the cable, thereby illuminating the LED and providing an immediate indication of the exact termination point of a given patch cord being tested.

Diodes are inserted between the positive flow of current and the RJ plug protecting both the circuit from a terminal condition as well as the device to which the network port is connected from a potentially harmful voltage condition. The insertion of a diode provides an isolated, closed loop circuit for the operation of the lamp. By allowing illumination of the opposite end of a given patch cord without removing the patch cord from service, the corresponding end of a given patch cord can be identified even as the cord remains in service.

The operation of the invention allows a network administrator or wiring technician to reconfigure cabling utilizing the invention without the need to physically retrace the topography or configuration of the patch cord, or to disconnect the patch cords to apply testing equipment to determine whether a particular modular plug is actually terminated with an identified opposite end of the same cable. Additionally, a technician may install an unlimited number of cables simultaneously without having to "map" each connection. A bundle of perhaps one hundred cables may be put into place through the cable management devices and upon connection to the patch panel, individual cable may be identified with the push of a button and subsequently connected to their desired device. In such a scenario, five to ten such cables may typically be correctly identified using the invention and connected in the time it takes to log a single patch connection without the invention.

In an alternate preferred embodiment, a single modular connector contains the battery, switch and the LED such that the illumination and identification process may be initialed from either end of a cable.

DETAILED DESCRIPTION OF THE PREFERRED EMBODIMENT

Figure 1:
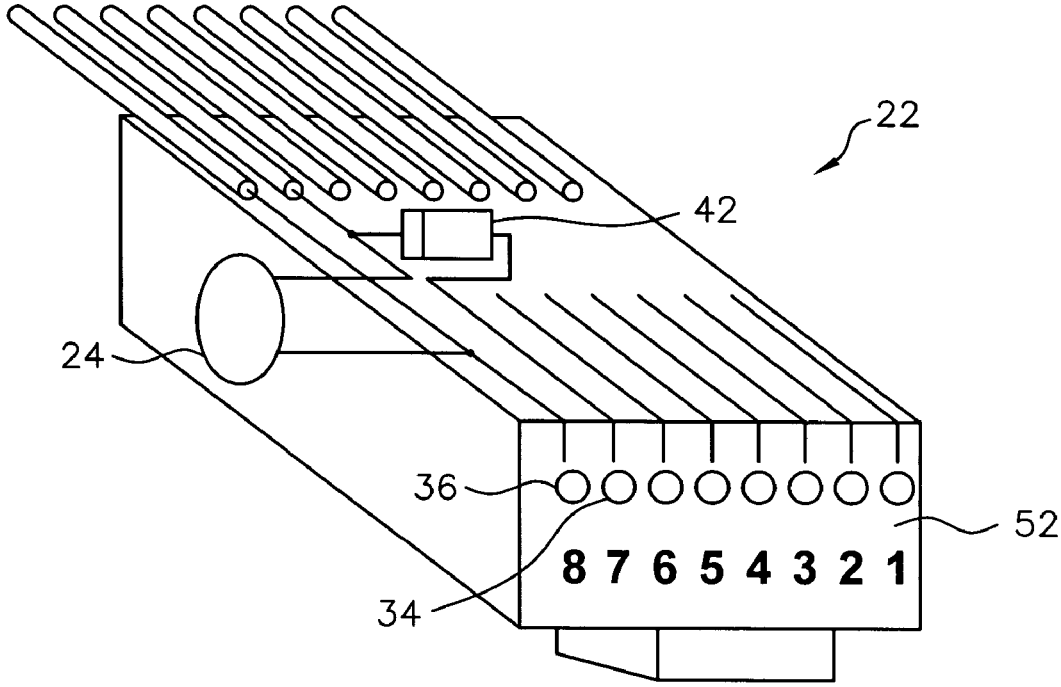
FIG. 1 is a pictorial diagram of an RJ45 modular connector comprising the illumination end of a patch cord utilizing the present invention.
Figure 2:
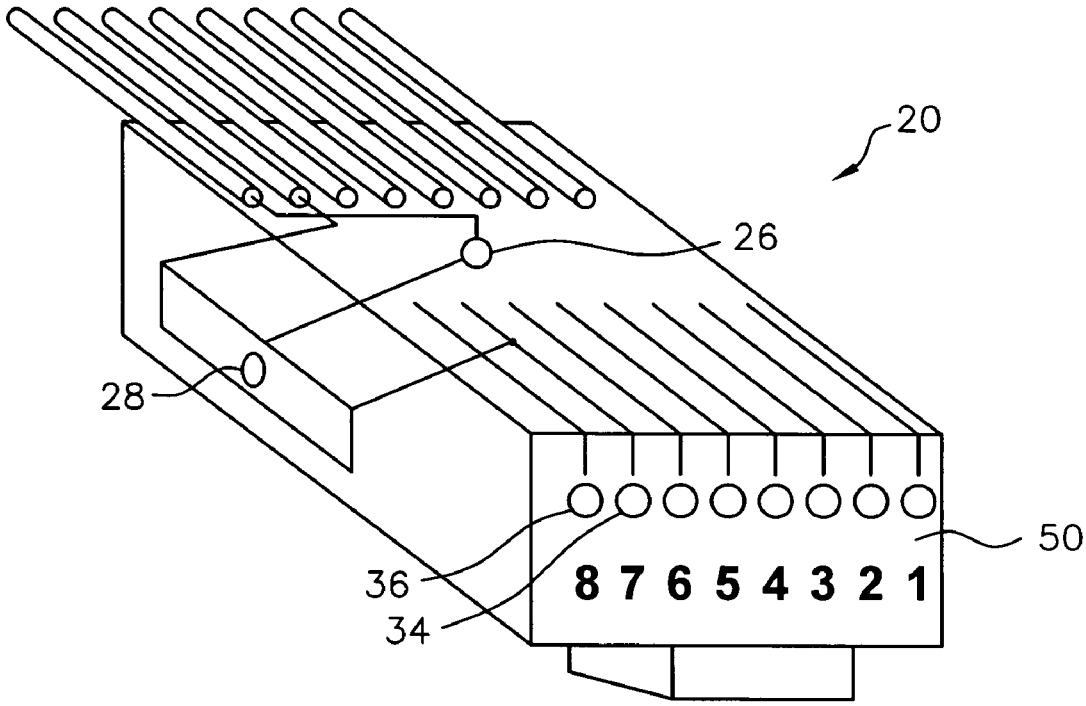
FIG. 2 is a pictorial diagram of an RJ45 modular connector illustrating the switch and selector end of a patch cord utilizing the present invention.

And now the invention shall be described in terms of the preferred embodiment utilizing various figures provided wherein like-numbers refer to like-parts. The invention may be applied in two different, but generally similar embodiments depending on the application and convenience desired in the use of the cables to which the inventions are applied. FIGS. 1 and 2 present the internal configuration of a complimentary pair of RJ45 type modular connectors which are used in the first embodiment of the invention where complete compatibility to the power over ethernet protocol remains available where a user may desire to apply the invention in such an environment.

Figure 3:
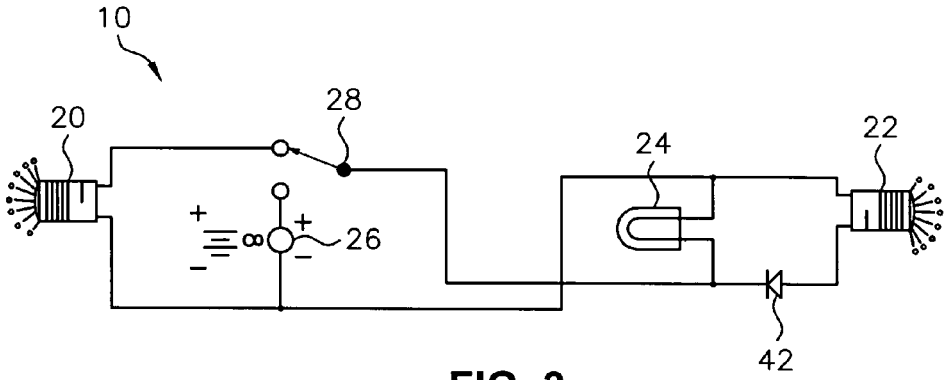
FIG. 3 is a schematic diagram of the invention which employs separate connector configurations at either end of a typical patch cord utilizing the present invention.

FIG. 3 is a schematic diagram illustrating the typical configuration of a telecommunications interconnect cable for data or voice devices which contain a visual identification component for the purposes of identification of the opposite end of the termination of a given individual cable. For purposes of clarity, it should be appreciated that FIG. 3 shows an exploded view of connector 22 and 20, wherein FIG. 1 illustrates modular connector 22 in a configuration as constructed and FIG. 2 likewise illustrates a modular connector 22 as constructed in operation.

Figure 4:
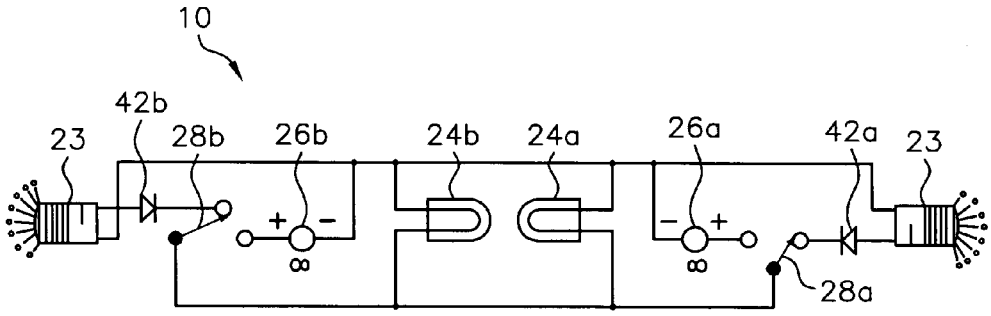
FIG. 4 is a schematic diagram of the alternate embodiment of the invention which utilizes a single plug configuration applied to a typical patch cord utilizing the present invention.

FIG. 4 shows an alternate embodiment of the invention which provides for a unitary design of the connectors so that only one configuration of plug is needed and each plug contains a switch to light a LED on the connector disposed on the opposite end of the cable to which the connectors are applied. It can be seen that the connector design presented in FIG. 4 provides for the same general wiring scheme utilizing the same wire pair illustrated as will be discussed below.

In returning to FIG. 3, a generic cable is illustrated which is comprised of a category cable typically using an Electronic Industry Association (EIA) standard Category 3, Category 5, or Category 6 unshielded twisted pair cable terminating in an RJ-style connector intended to connect two independent devices complying with the set standard. Examples of such devices that are in common use today utilizing patch cables are hubs, switches, patch panels, routers, telephone PBX, POE injectors, data repeaters, gateways, and other such data network and telecommunications accessories and devices utilizing connectors and patch cables to configure and reconfigure such systems to be flexible with the requirements of the user. The cable, typically UTP consists of four pairs of individually coded copper wires, thereby comprising eight separate conductors. The wires encased in insulation with the wires laying parallel to each other at their termination point as suggested by FIG. 1 and FIG. 2 illustrating a typical connector. In the preferred embodiment of the invention, the wiring conforms to a standard EIA-568 wiring configuration, but terminates through a modified RJ45 connection which utilizes typically unused pairs in the standard configuration to accomplish the improvements of the invention.

Referring now to FIG. 1, a pictorial diagram illustrating illumination section of a patch cable in the preferred embodiment is shown. The invention utilizes a generally conventionally dimensioned RJ45 connector 22, but further contains internal components molded into the connector. Also, it should be appreciated that both connector 20 and 22 are slightly larger in the portion of each connector which is external to the female RJ45 connectors into which the male connectors are plugged. The actual terminal portions of each connector are identical in dimensions as any standard RJ45 connector. The housing on the body of each connector is enlarged to contain the components needed, though there is no problem with compatibility as such portions remain outside of the female plug and do not interfere with the operation of the connector. Connector 22 is comprised of the termination end of the connector 52 which is wired with a total of eight separate pins as would be immediately recognized by those skilled in the art. Utilizing the existing data pair for pin 7 shown at 34, pin 8 shown at 36 the Category 5 data pair 4 in the EIA T-568A or T-568B configuration is used. Although not normally incorporated into most uses, the data pair utilized in the present invention may be used in an application for data purposes since the invention isolates the use of the pairs to apply DC power across the patch cord through the use of diodes and a momentary switch.

Turning now to FIG. 1, illumination connector 22 places light emitting diode 24 across conductor number 7 shown at 34, and conductor number 8 shown at 36. By placing isolation diode 42 in parallel with light emitting diode 24, insulation is achieved by allowing direct current to be applied across the pair, thus illuminating light emitting diode 24 and providing isolation of any reverse current or other low level signal that may appear on the pair being used as well as limiting an undesired voltage condition to the end device.

It would be appreciated by those skilled in the art that by applying a low voltage across light emitting diode 24, the diode would be illuminated and would provide an indication of a DC signal being placed or presented across it. Light emitting diodes are well known in the art, and are available in a variety of different configurations, sizes, colors and illumination brilliance. In the present invention, connector 22 is constructed with the light emitting diode integrated in the plastic molding that is used in the construction of RJ45s.

Likewise, diode 42 may be placed within the connector to provide it with protection, or could be placed at the termination point of conductor 34 where it is molded or crimped into connector 22. In all other respects, connector 22 is a standard connector and is applied in the same manner as any other modular connector is used in the modern patch cord environment. By placing diode 42 and light emitting diode 24 within the connector itself, it can be appreciated that the connector can be applied without external apparatus required to place a conventional Category 5 cable into service as a patch cord utilizing the present invention, and not be limited to a specific cable brand, length, color, or application.

Turning to FIG. 2, switch connector plug 20 of the present invention is shown in pictorial form. Just as in the opposite end of the cable which utilizes connector 22, connector 20 uses the same conductors 34 and 36, thereby comprising a pair known as the fourth pair in the conventional EIA T-568A or T-568B configuration as universally applied. Modular connector 20 utilizes a single pole, double throw momentary contact switch 28 which applies voltage across the fourth pair by completing the continuity between battery 20 and conductor 34 and 36 as illustrated in FIG. 2. When switch 28 is activated, a voltage is presented across the pair and is transmitted through the patch cord to connector 22, thus illuminating the light emitting diode 24.

Since the connectors in the first preferred embodiment have the components illustrated in FIG. 1 and FIG. 2 integrated into the molding of the connector, all connections to the connectors are accomplished using standard RJ termination shown at 50 and 52 utilizing crimp-style termination as is most commonly used to connect registered jack-type of termination, such as RJ-11 and RJ45s as illustrated in the figures.

Returning to FIG. 3, the entire invention is shown in electrical schematic form, wherein patch cable 10 is comprised of illumination connector 22, switch connector 20, diode 40 and button cell 26 with switch 28. Light emitting diode 24 is shown in series with diode 42, although it should be appreciated that for illustration purposes the schematic representation of the internal components are shown outside of connector 20 and 22 for clarity.

It should also be appreciated that it would be possible to use the illumination method and connectors in other standard modular jack or patch cord configurations, whether using registered jacks, phono jacks, or other types of connectors where there may be either multiple pairs available for the application of DC voltage across the patching cable, or the patch cable can impress DC voltage across a given pair which is isolated from any signal being conducted through the cable. Such applications would be useful at broadcast facilities as well as other studio-type configurations where there are dozens or perhaps hundreds of patch cables from rack-mounted connection areas reconfiguration of processing equipment whether it would be for analog signals or data, telecommunications or other uses as well as hybrid configuration where category cabling is configured for custom application such as alarm systems, commercial electronic locking mechanisms (office, airport, police stations, etc.), test equipment (control panel with multiple connections to the device to be tested), etc.

Moreover, it can also be appreciated that in some situations it may be desirable to allow activation of the present invention from either end of a given patch cord. Therefore, an alternate embodiment of the present invention presented in FIG. 4 would provide for an integration of connector 20 and 22, yielding connector 23, thereby allowing that a button battery, momentary contact switch, and light emitting diode along with isolation diodes as may be desirable would be integrated into a connector which would allow illumination of both ends of a given cable by applying switch pressure at either end of the cable that would have a momentary contact switch. Although the cost might be higher for the use of such modular connectors because of the additional components required, it could be appreciated that by use of a unitary design only one style of modular connector would be necessary since the same connector would be applied to both ends of the same cable.

Connector 23 shown in FIG. 4 is internally configured to be identical on both ends of the cable allowing access to switch 28*a* or 28*b* on either end of cable 10. In FIG. 4, patch cable 10 is comprised of identical connector 23. Each internally are comprised of light emitting diode 24, button battery cell 26, and momentary contact, single pole, double throw switch 28. In addition, each connector contains isolation diode 42 which functions in a similar fashion as shown in the circuit shown in FIG. 3. In each instance, it can be appreciated that the components described in FIG. 4 are identical on either end of the cable, since connector 23 is identical, thereby allowing switch 28 to be present on each connector as such switch is presented in FIG. 2. Pressing switch 28*a* or 28*b* will light the LED on each end of cable 10 as long as the switch is depressed. For example, pressing switch 28 will illuminate diode 24*a* and 24*b*. Pressing switch 28*b* will illuminate diode 24*a* and 24*b*. Therefore, in this configuration it can be appreciated that either end of the cable can be used to illuminate the opposite end, as opposed to using the mating design suggested in FIGS. 1 through 3. The only disadvantage that may be presented in the design depicted in FIG. 4 is the existence of diode 42*a* and 42*b*. With this diode in place, should one wish to send a signal over ethernet cable conductors 7 or 8, depicted as 34 and 36 in FIGS. 1 and 2, diode 42*a* and 42*b* may prevent that from occurring because of the way the diodes are configured in the circuit. It should be appreciated that currently, except in limited special applications, the pair being used to accomplish the results described are not normally configured in the ethernet standard, as explained above, but may be used in limited circumstances if an application wished to impress a DC voltage across the conductors to provide power to a remote network component by supplying DC power over an ethernet. If such a configuration is applied, it can be seen that the design of the connector pairs in FIG. 3 would allow DC voltage to flow in one direction given the configuration of diode 42 in those diagrams. In certain applications it can also be seen that diode 42 can be eliminated, thereby eliminating reverse polarity protection, but allowing the cable configuration to be used without concern for polarity limitations presented by using diode 42.

Although the invention has been described in accordance with the preferred embodiment and a useful alternative embodiment, it will be appreciated by those skilled in the art that the application of the present invention is useful in a variety of configurations and designs not specifically described above. All such designs and applications are considered to be within the scope of the present disclosure, and the invention is applicable across a wide variety of patch cable connection applications where immediate identification of an opposite end of the given patch cable of any configuration is desirable. Such applications are considered within the scope and spirit of the present invention.

What is claimed is:

1. A system for locating corresponding ends of a patch cable used to conduct a signal between a first cable end and a second cable end, the system comprising a cable having a main signal transmission means and a pair of electrically conducting members extending along the length of the cable, further including;

a pair of identical connectors attached to each end of said cable, adapted to removably mate with matching receptacles;

each said connector having at least one pair of leads associated therewith operatively corresponding to and utilizing a common pair of contact points;

each said connector having an integrated source of DC voltage which can be selectively placed across the said pair of leads upon the activation of an integral switch within each said connector; and each said connector having a lamp operatively attached across the corresponding pair which illuminates upon the activation of said momentary contact switch in each connector.

2. A system for locating corresponding ends of a patch cable used to conduct a signal between a first cable end and a second cable end, the system comprising a cable having a main signal transmission means and a pair of electrically conducted members extending along, the length of the cable, further including;

a first connector attached to one end of said cable;

a second connector attached to the other end of said cable, wherein said first and second connectors are adapted to removably mate with matching receptacles;

said first connector having at least one pair of leads associated therewith operatively connected to and corresponding to said second connector utilizing a common pair of contact points;

said first connector having an integrated source of DC voltage which can be selectively placed across the pair upon the activation of an integral switch within said first connector;

said second connector having a lamp operatively attached to the corresponding pair which illuminates upon the activation of said switch in the first connector.

3. A method for locating corresponding ends of a patch cable used to conduct a signal between a pair of connectors, the patch cable including a cable having a main signal transmission member and a source of DC voltage located within the cable connector, a pair of electrically conductive members and a cable connector containing an indicator lamp, wherein the method comprises;

activating a switch on a first cable connector which is disposed to apply a DC voltage across a pair of conductors within said patch cable;

and illumination of the said indicator lamp on a second said connector of said patch cable upon activation of said switch which indicates the terminus of the patch cable.

4. An indicator assembly adapted for attachment to a patch cable connector having multiple leads, the connector configured to mate with a receptacle, the connector having two electrical leads that are electrically connected to corresponding conductive members that extend along the cable, the indicator assembly comprising:

a means for selectively applying voltage across the conductive members;

a means for isolating said voltage from being conducted outside said patch cable when said voltage is selectively applied;

a means for providing an indication on said connector that the said voltage has been applied.

5. A method for locating corresponding ends of a patch cable used to conduct a signal between a pair of connectors, the patch cable including a pair of electrically conductive members and a cable connector containing a lamp, a switch and a voltage source located within the cable connector activated by the switch all of which are operatively connected to said pair of conductive members; the method comprising:

electrically isolating the pair of conductive members to block said voltage source from being conducted through the said pair of connectors, activating a button on a first cable connector which is disposed to apply said voltage source across said pair of conductors within said patch cable;

illumination of a lamp on a second said connector of said patch cable which indicates the terminus of the patch cable while the cable is in service.

6. A system for locating corresponding ends of a patch cable used to conduct a signal between a first cable end and a second cable end, the system comprising a cable having a main signal transmission means and a pair of electrically conducting members extending along the length of the cable, further including;

a pair of identical connectors attached to each end of said cable, adapted to removably mate with matching receptacles;

each said connector having at least one pair of leads associated therewith operatively corresponding to and utilizing a common pair of contact points;

each said connector having an internal source of DC voltage which can be selectively placed across the said pair of leads upon the activation of an integral switch within each said connector; and each said connector having a lamp operatively attached across the corresponding pair which illuminates upon the activation of said momentary contact switch in each connector.

7. A system for locating corresponding ends of a patch cable used to conduct a signal between a first cable end and a second cable end, the system comprising a cable having a main signal transmission means and a pair of electrically conducted members extending along the length of the cable, further including;

a first connector attached to one end of said cable;

a second connector attached to the other end of said cable, wherein said first and second connectors are adapted to removably mate with matching receptacles;

said first connector having at least one pair of leads associated therewith operatively connected to and corresponding to said second connector utilizing a common pair of contact points;

said first connector having an integrated source of DC voltage within said first connector which can be selectively placed across the pair upon the activation of an integral switch within said first connector;

said second connector having a lamp operatively attached to the corresponding pair which illuminates upon the activation of said switch in the first connector.

8. A networking cable used to conduct a signal between a first cable end and a second cable end, the cable comprising at least four pairs of conductors, said cable comprising:

a first connector attached to one end of said cable;

a second connector attached to the other end of said cable, wherein said first and second connectors are adopted to removably mate with matching receptacles;

said first and second connectors connecting each of the four pairs of conductors such as to provide for continuity of each conductor from said first connector to said second connector;

said first connector having an integrated source of DC voltage contained within said connector which can be selectively placed across at least one pair of conductors upon the activation of an integral switch configured within said first connector;

and said second connector having a lamp operatively attached to the corresponding pair of conductors which illuminates upon the activation of said first switch in the first conductor.

9. The networking cable of claim 8 wherein said integrated source of DC voltage is comprised of a battery within said connector.

10. The networking cable of claim 8 wherein further said integrated source of DC voltage is isolated such that the said DC voltage is confined within the cable when applied.

* * * * *